US011168877B2

(12) United States Patent
Zheng et al.

(10) Patent No.: US 11,168,877 B2
(45) Date of Patent: Nov. 9, 2021

(54) STRIP LIGHTING WITH CONNECTION MECHANISM AND INSTALLATION MODULE

(71) Applicants: Self Electronics Co., Ltd., Zhejiang (CN); Wanjiong Lin, Zhejiang (CN); Self electronics USA Corporation, Norcross, GA (US)

(72) Inventors: Zhaoyong Zheng, Zhejiang (CN); Junqi Fang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 16/902,178

(22) Filed: Jun. 15, 2020

(65) Prior Publication Data

US 2020/0408396 A1 Dec. 31, 2020

(30) Foreign Application Priority Data

Jun. 27, 2019 (CN) ..... 201910572294.8

(51) Int. Cl.
*F21V 23/06* (2006.01)
*F21S 4/28* (2016.01)
(Continued)

(52) U.S. Cl.
CPC ..... *F21V 23/06* (2013.01); *F21S 4/28* (2016.01); *F21V 17/12* (2013.01); *F21V 19/04* (2013.01); *F21V 21/30* (2013.01); *H01R 13/00* (2013.01); *H01R 13/6277* (2013.01); *H01R 24/00* (2013.01); *H01R 24/38* (2013.01); *H01R 24/50* (2013.01); *H01R 24/58* (2013.01); *F21Y 2115/10* (2016.08)

(58) Field of Classification Search
CPC .... F21S 4/20; F21S 4/28; F21V 21/14; F21V 21/30; F21V 23/06; H01R 13/6277; H01R 24/38; H01R 24/50; H01R 24/58
See application file for complete search history.

(56) References Cited

U.S. PATENT DOCUMENTS 5,559,681 A * 9/1996 Duarte ..... F21V 21/08 362/231
8,297,788 B2 * 10/2012 Bishop ..... F21V 23/06 362/249.02

(Continued)

OTHER PUBLICATIONS

Azo Nano, A Material that has High Electrical Conductivity and can Stretch and Contract like Rubber, Aug. 21, 2016, Nanomaterials, Nanotubes (Year: 2016).*

*Primary Examiner* — Keith G. Delahoussaye
(74) *Attorney, Agent, or Firm* — Wang Law Firm, Inc.

(57) ABSTRACT

A strip light has a strip lighting body and a lighting end cover fixedly arranged at both ends of the strip lighting body, the strip lighting has a connection mechanism fixedly disposed in the lighting end cover and one end of which electrically connected to the PCB board in the strip lighting body, and an installation module that is electrically connected to other end of the connection mechanism and detachably connected to the lighting end cover for easy replacement. Compared with the prior art, the strip lighting features a variety of installation methods of the lighting and the lighting angle can be adjusted 360 degrees, thereby improving the competitiveness and availability of the lighting.

11 Claims, 9 Drawing Sheets

(51) Int. Cl.

| | |
|---|---|
| ***F21V 17/12*** | (2006.01) |
| ***F21V 19/04*** | (2006.01) |
| ***F21V 21/30*** | (2006.01) |
| ***H01R 24/58*** | (2011.01) |
| ***H01R 24/50*** | (2011.01) |
| ***H01R 13/627*** | (2006.01) |
| ***H01R 13/00*** | (2006.01) |
| ***H01R 24/00*** | (2011.01) |
| ***H01R 24/38*** | (2011.01) |
| *F21Y 115/10* | (2016.01) |

(56) References Cited

U.S. PATENT DOCUMENTS

| | | | | |
|---|---|---|---|---|
| 9,647,349 | B1 * | 5/2017 | Stillman | H01R 4/2445 |
| 10,415,814 | B2 * | 9/2019 | Kay | F21V 21/005 |
| 10,683,973 | B2 * | 6/2020 | Chami | F21V 23/06 |
| 2004/0246714 | A1 * | 12/2004 | Talamo | E01F 9/30 362/225 |
| 2013/0301255 | A1 * | 11/2013 | Kim | F21V 23/06 362/218 |
| 2015/0345755 | A1 * | 12/2015 | Purdy | F21V 17/16 362/219 |

* cited by examiner

STRIP LIGHTING WITH CONNECTION MECHANISM AND INSTALLATION MODULE

RELATED APPLICATION

This application claims priority to a Chinese Patent Application No. CN 201910572294.8, filed on Jun. 27, 2019.

FIELD OF THE TECHNOLOGY

The present invention relates to the field of lighting technology, with particular emphasis on a strip lighting.

BACKGROUND OF THE INVENTION

Strip LED lights are widely used in shopping mall showcases, museum showcases and other places, but the current structural design of strip lights only corresponds to one installation method, that is, the current design structure of strip lights makes the fixture installation method fixed in advance. A light can only correspond to one installation method, but cannot choose the installation method according to the actual installation environment.

At the same time, the existing lighting structure cannot realize the interconnection and combination of various lighting modules such as the light scanning module, the key lighting module, and the linear light source module according to the actual needs of users, resulting in a single use effect of the lighting. Moreover, the current strip lighting structure cannot achieve multi-angle adjustment and cannot meet the lighting requirements of different angles.

BRIEF SUMMARY OF THE INVENTION

In view of the above problems, an object of the present invention is to provide a strip lighting that can satisfy various installation methods and allow various lighting modules to be arbitrarily combined.

The object of the present invention is also to provide a strip lighting which can realize multi-angle adjustment.

To achieve the above purposes, the technical scheme of the invention is as follows: a strip lighting, comprising a strip lighting body and a lighting end cover fixedly arranged at both ends of the strip lighting body, characterized by:

the strip lighting further comprises a connection mechanism fixedly disposed in the lighting end cover and one end of which electrically connected to the PCB board in the strip lighting body, and an installation module electrically connected to other end of the connection mechanism and detachably connected to the lighting end cover for easy replacement.

advantageously, the installation module is electrically connected to other end of the connection mechanism in a pluggable method.

advantageously, a slot formed along the length direction of the strip lighting body is provided on the other end of the connection mechanism, and a first contact pin is disposed in the slot along the length direction of the strip lighting body, correspondingly, an insertion barrel is provided at one end of the installation module, and a second contact pin formed along the length direction of the insertion barrel is provided in the insertion barrel, the first contact pin is adapted to be inserted into the insertion barrel and to make electrical contact with the second contact pin.

advantageously, the insertion barrel can rotate in the slot to realize the rotation of the strip lighting body relative to the installation module.

advantageously, the lighting end cover is a cylindrical body with openings at both ends and a hollow columnar structure inside.

advantageously, the installation module comprises a DC plug which is an "L" structure formed by a female plug and a male plug, a DC end cap sleeved on the outer periphery of the female plug and fixed with the female plug, and a vertical bracket connected to the male plug to support the entire strip lighting, the insertion barrel is formed on the female plug, and the female plug sleeved with the DC end cap extends into the lighting end cover and is electrically connected to the connection mechanism.

advantageously, the diameter of the DC end cap extending into the lighting end cover is adapted to other end of the connection mechanism, so that the DC end cap is fitted on the other end surface of the connection mechanism.

advantageously, an annular groove is provided on the surface of the portion of the DC end cap extending into the lighting end cover, and an O-ring is provided in the annular groove, and an annular groove for embedding the O-ring is provided at a corresponding position on the inner wall of the lighting end cover to prevent the DC end cap from rotating arbitrarily.

advantageously, the male plug is inserted into the vertical bracket and an O-ring is provided between the male plug and the vertical bracket to prevent the male plug from rotating randomly.

advantageously, the DC end cap and the female plug are provided with mounting holes, and the DC end cap and the female plug are fixed by screws.

advantageously, the installation module comprises a cylindrical connecting piece that is open at both ends and connects the strip lighting and the strip lighting in series;

the cylindrical connecting piece is provided with the insertion barrel and the second contact pin formed and connected along the respective opening directions, and the ends of the cylindrical connecting piece can respectively extend into the lighting end cover of the corresponding strip lighting, so that the insertion barrel and the slot, the second pin and the first pin are connected correspondingly.

advantageously, the surface of the cylindrical connecting piece is provided with an O-ring which can prevent the cylindrical connecting piece from rotating randomly within the lighting end cover.

advantageously, the installation module is a plug-in wiring, one end of which forms the insert barrel and the second contact pin and other end is connected to a wire to realize the overall surface mounting of the strip lighting installation.

advantageously, an elastic sheet electrically contact with the PCB board is provided on one end of the connection mechanism.

Compared with the prior art, the present invention has the advantage that: Replace the design structure of immobilized installation mode of the strip lighting, which used to be connected directly with PCB board by wires, with an electrical connection between the connecting mechanism and PCB board set in the lighting end cover. The installation module is detachably connected to the lighting end cover and is in electrical contact with the PCB board through the connection mechanism. According to actual needs, only the installation module needs to be replaced to achieve surface mount, vertical, cascade and other different ways of installation. Such modular design improves the applicable scope and environment of the lighting body, and the design that the inserting barrel can rotate relative to the slot can adjust the installation angle of the strip lighting body relative to the installation module according to the lighting angle, realizing the adjustable lighting angle, further ensuring the applicable scope of the strip lighting and increasing the use value of the lightings.

DETAILED DESCRIPTION OF THE INVENTION

Hereinafter, specific embodiments of the present invention will be described in further detail based on the drawings. It should be understood that the description of the embodiments of the present invention is not intended to limit the protection scope of the present invention.

Figure 1:
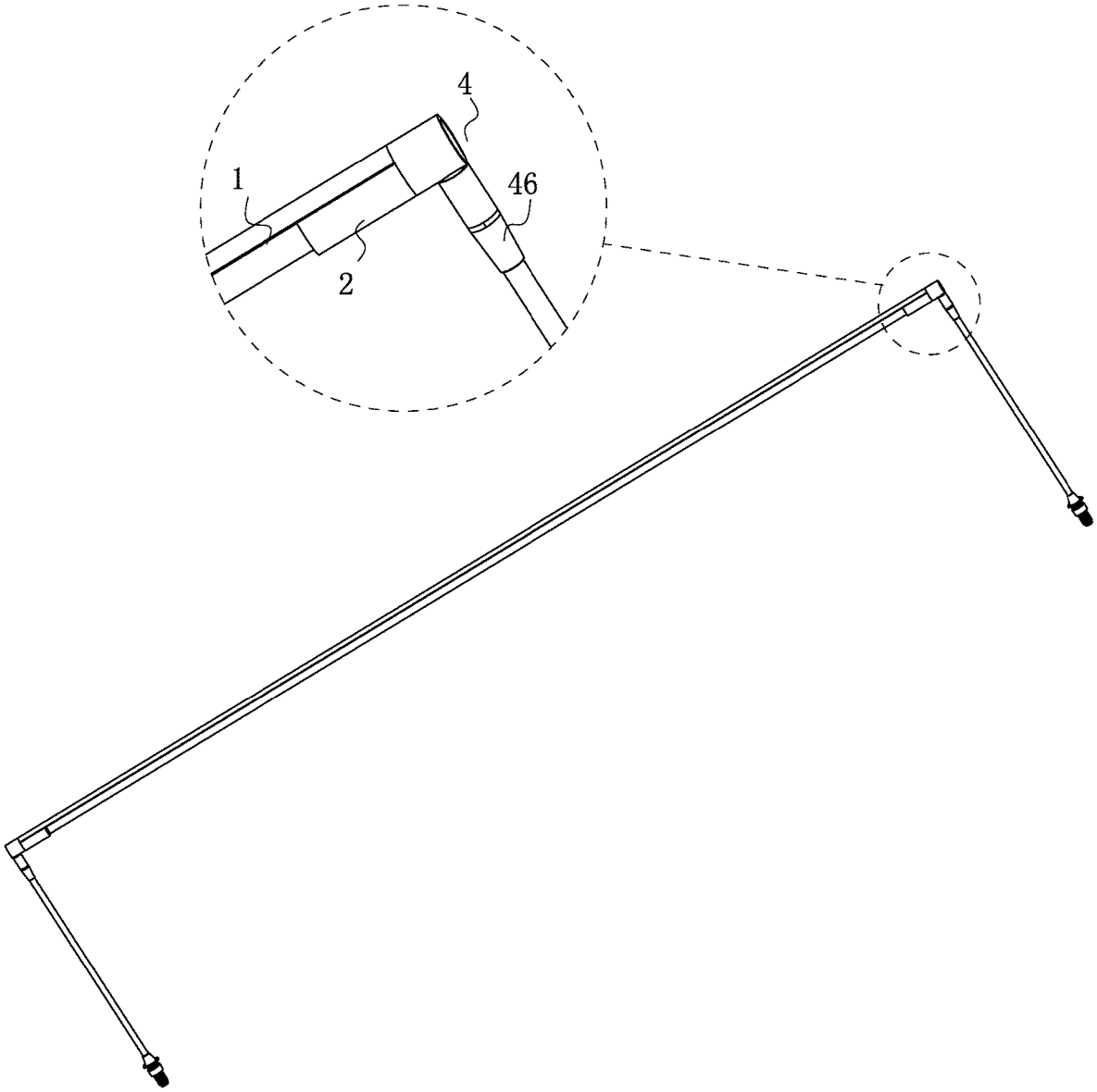
FIG. 1 is a structural diagram of the first embodiment of the strip lighting of the present invention.
Figure 2:
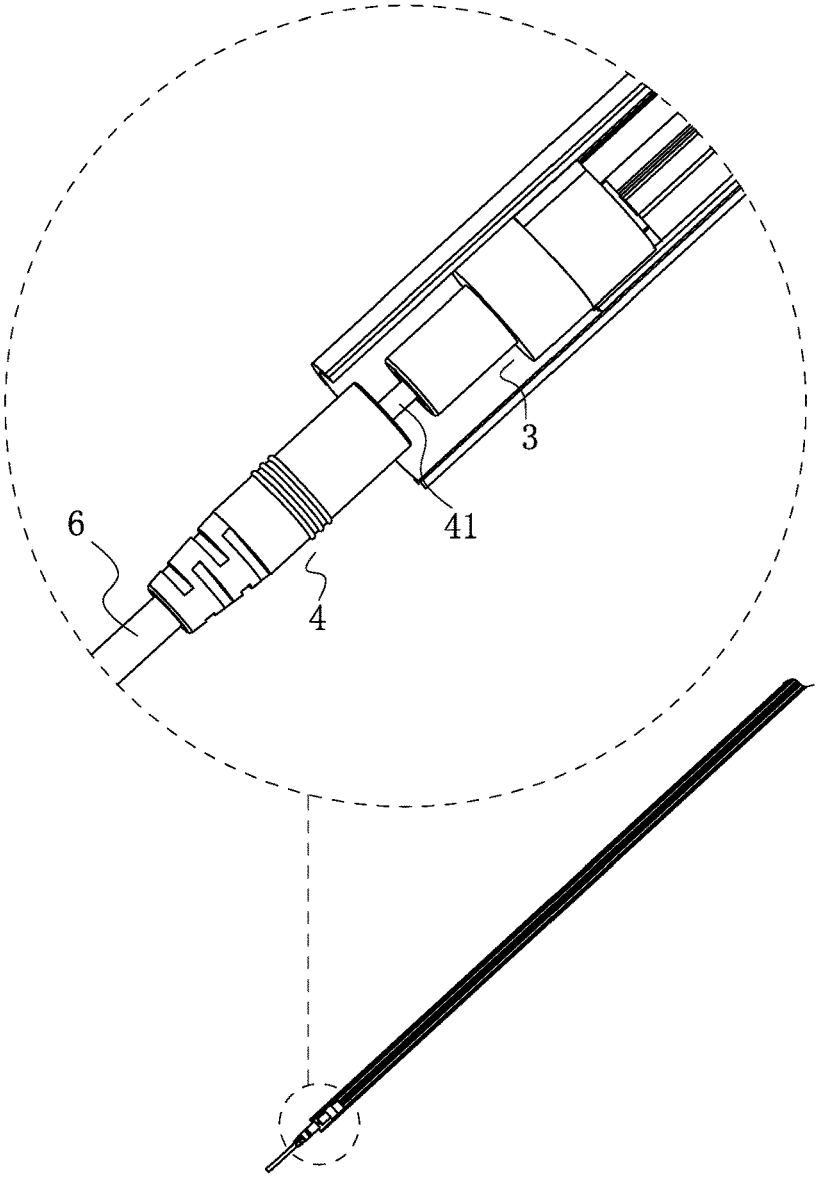
FIG. 2 is a partial structural diagram of the second embodiment of the strip lighting of the present invention after one end is removed.
Figure 3:
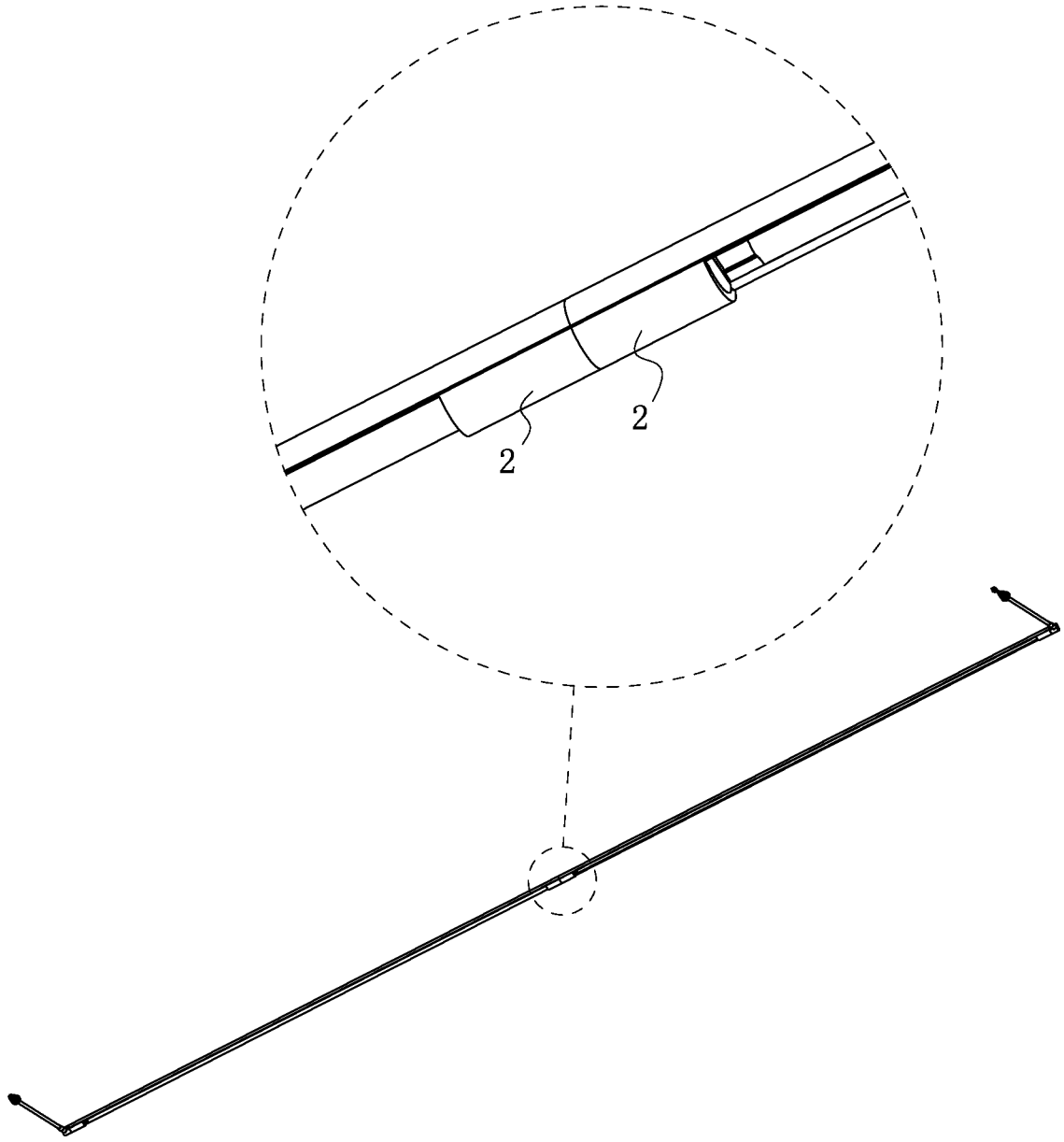
FIG. 3 is a structural diagram of the third embodiment of the strip lighting of the present invention.

As shown in FIG. 1 to 3, schematic diagrams of three different embodiments of the strip lighting of the present application are shown, but it should be noted that these are only examples and do not mean that the strip lighting of the present application only has three types of installation methods. On the contrary, technical solutions that are formed by adopting structures that are substantially the same as or equivalent to this application fall within the scope of protection of this application.

The strip lighting of the present application is actually a modular design to achieve different installation methods of the lightings. Specifically, the strip lighting comprises a strip lighting body 1, a lighting end cover 2 fixedly arranged at both ends of the strip lighting body 1, a connection mechanism 3 fixedly disposed in the lighting end cover 2 and one end of which electrically connected to the PCB board 11 in the strip lighting body 1, and a installation module 4 electrically connected to the other end of the connection mechanism 3 and detachably connected to the lighting end cover 2 for easy replacement as required.

In the past, due to the high degree of correlation between the modules of the strip lightings, the structure of the strip lightings was too fixed, so that a lighting only corresponds to one installation method, and some strip lightings can only be surface-mounted, some lightings can only be installed vertically, and the lightings and lightings cannot be connected in series, and the installation environment of the lightings is often unknown, which is easy to cause the awkward situation sometimes the actual environment can only be suitable for surface mount assembly, and the purchased lightings are only suitable for vertical assembly, which not only causes waste of manpower and material resources, but also greatly reduces the use value of lightings.

In contrast, this application uses a modular design to make each module of the lighting independent, that is, the installation module is detachably connected to the lighting end cover, and the installation module is connected to the strip lighting body through the connection mechanism instead of the direct electrical connection in the past. The user can easily realize the assembly method suitable for the current lighting installation only by replacing the installation module, which greatly improves the utilization value and competitive advantage of the lighting.

Figure 5:
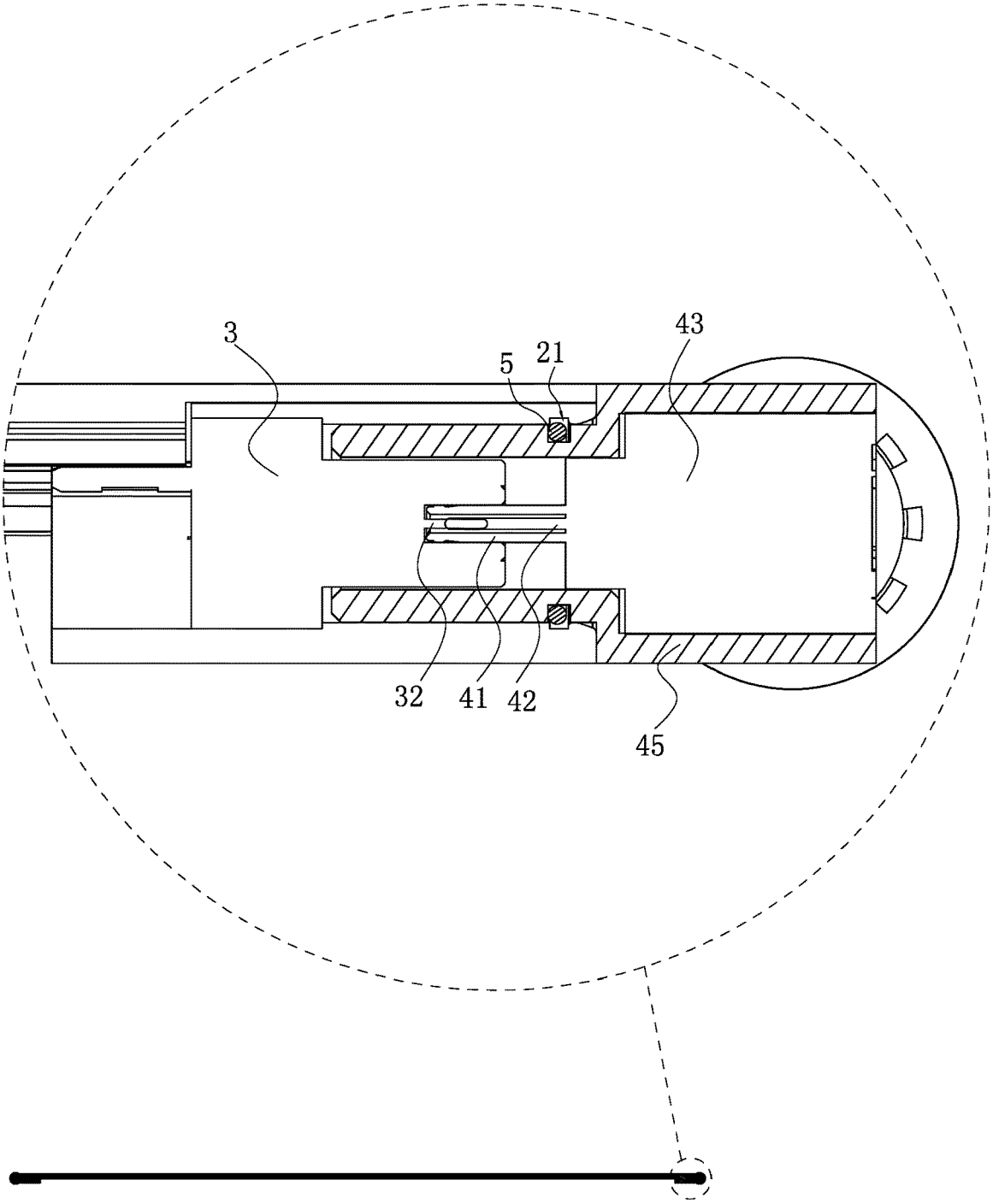
FIG. 5 is a cross-sectional diagram of FIG. 1.
Figure 6:
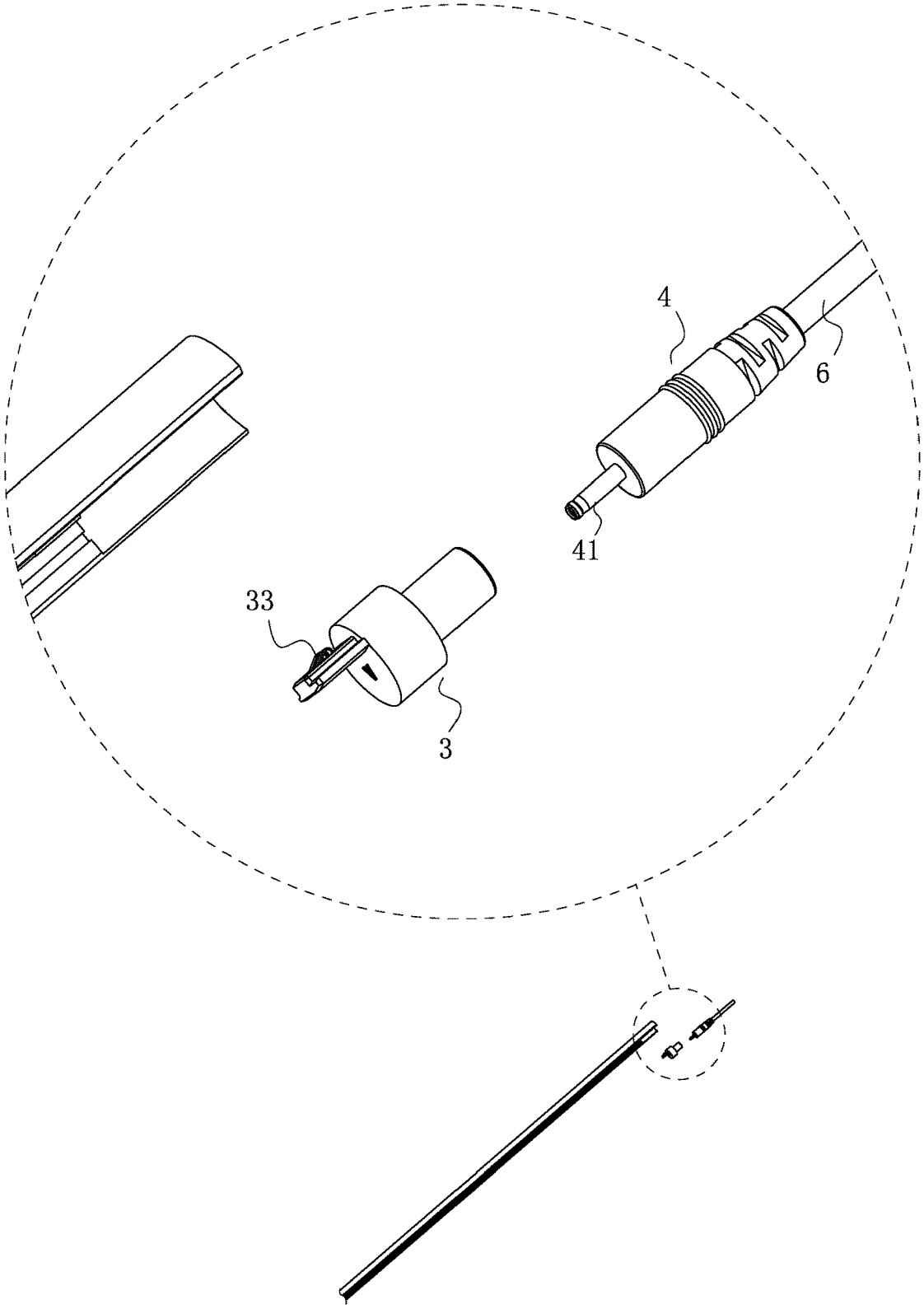
FIG. 6 is a partial exploded diagram of FIG. 2.
Figure 7:
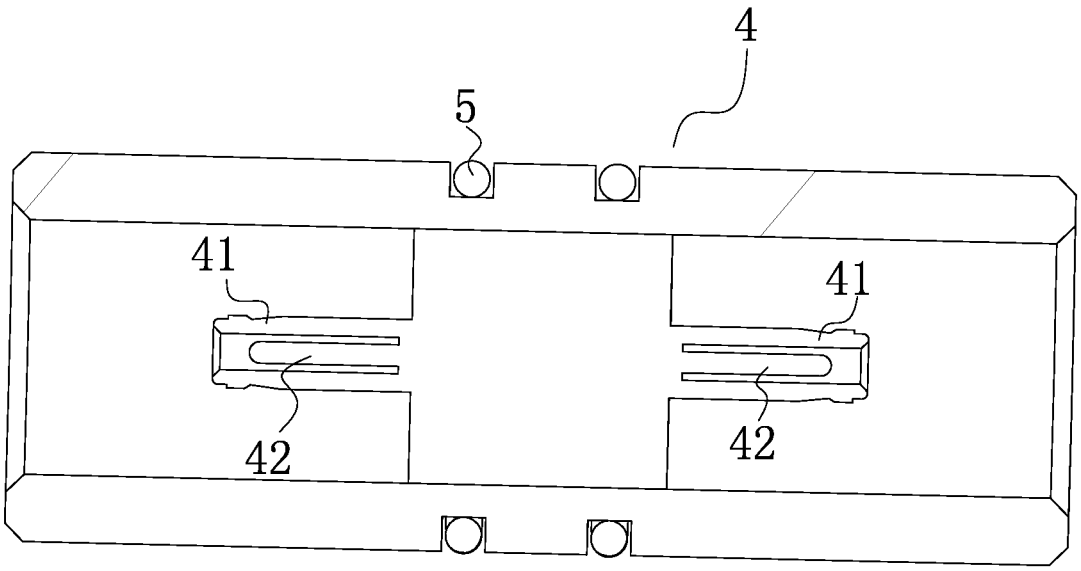
FIG. 7 is a cross-sectional diagram of the cylindrical connector in FIG. 3.
Figure 9:
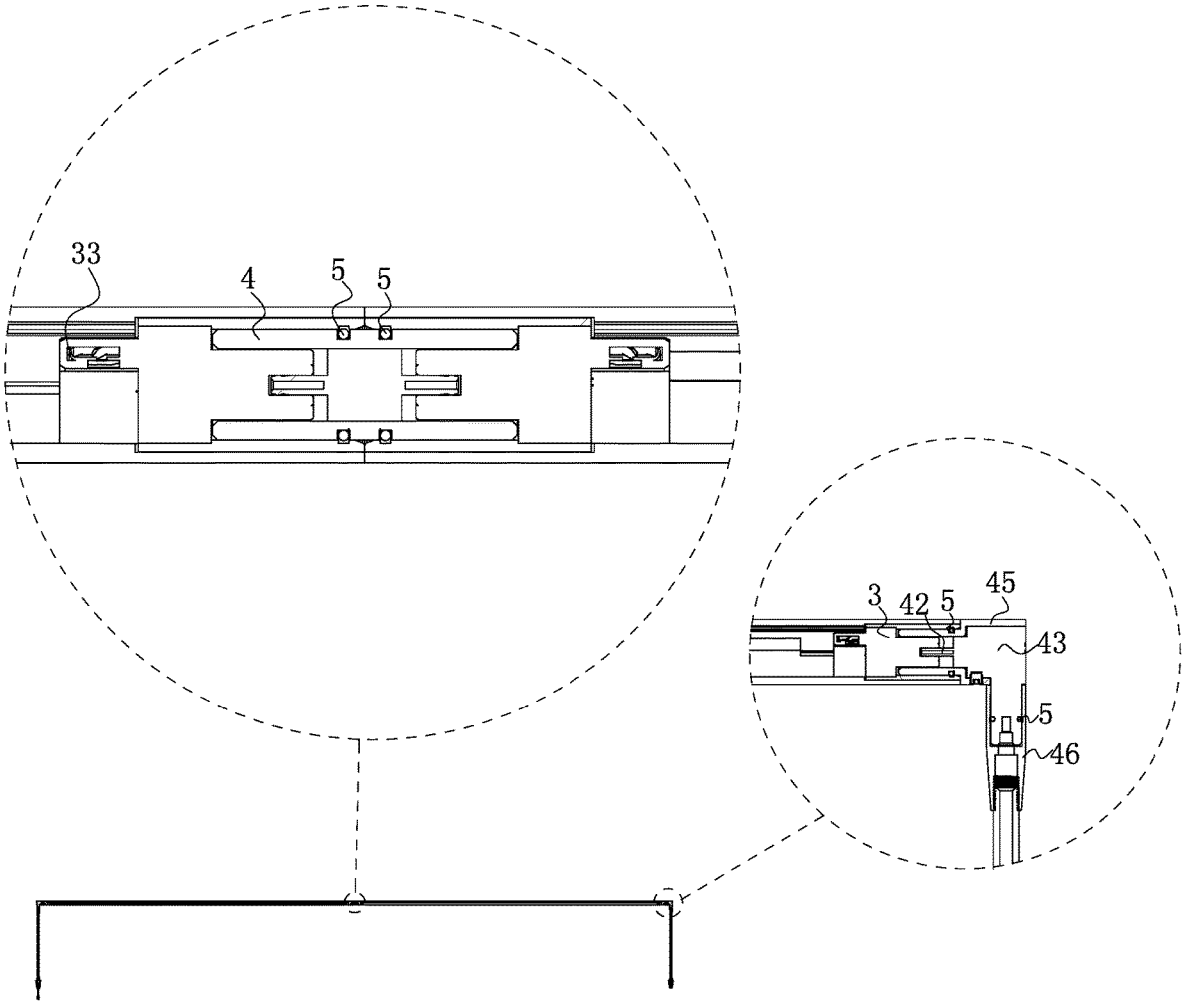
FIG. 9 is a partial cross-sectional diagram of FIG. 8.

In order to take into account both easy disassembly and good electrical contact, the installation module 4 of the present application and the other end of the connection mechanism 3 are electrically connected by a pluggable method, as shown in FIGS. 5, 6, and 9; At the same time, it can be seen from the above description that the applied installation module of the strip lighting has different structures according to actual needs. For details, please refer to FIG. 1 to 3, and the other components of the lighting have the same structure.

In other words, the pluggable mode and structure of the installation module 4 and connecting mechanism 3 here are applicable to multiple embodiments. In order to simplify the description, this application takes the first embodiment as the object and elaborates on this point in details (see below for details), while in other embodiments only different points are described.

Figure 4:
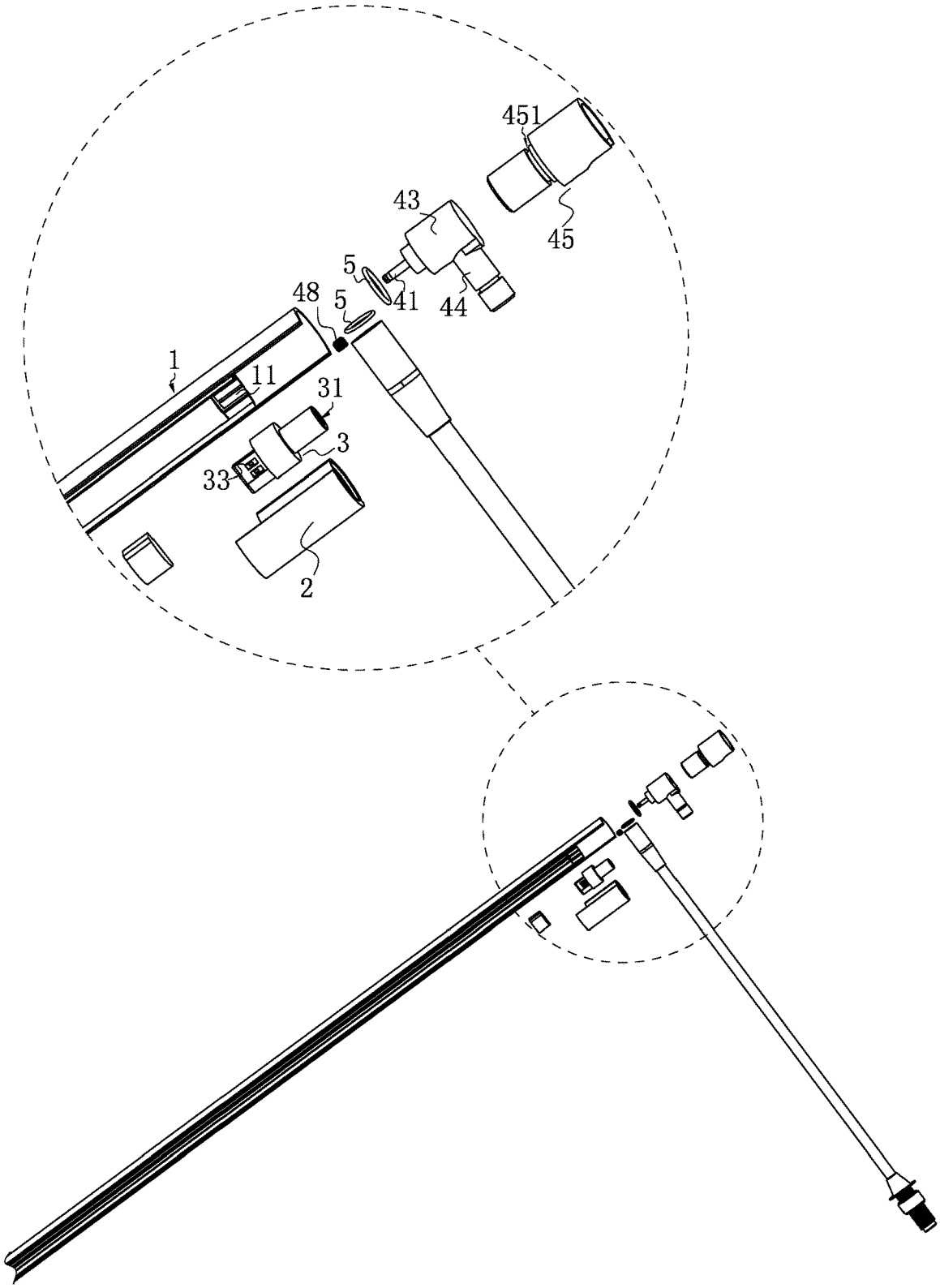
FIG. 4 is a partial exploded diagram of FIG. 1 with one end removed.

As shown in FIG. 4 to 5, the other end of the connection mechanism 3 is provided with a slot 31 formed along the length direction of the strip lighting body 1, and a first contact pin 32 is disposed in the slot 31 along the length direction of the strip lighting body, correspondingly, one end of the installation module 4 is provided with a insertion barrel 41, and a second contact pin 42 formed along the length direction of the insertion barrel 41 is provided in the insertion barrel 41, the first contact pin 32 is suitable for inserting into the insertion barrel 41 inside and in electrical contact with the second contact pin 42.

Of course, it can also be that the other end of the connection mechanism 3 only has slot 31 but no first contact pin 32, and one end of the installation module 4 is still formed with a insertion barrel 41 and a second contact pin 42. To achieve electrical connection, at this time, the bottom or inner wall of the slot 31 can be coated with a conductive coating; it can also be that the other end of the connection mechanism 3 forms a insertion barrel 41 and a second contact pin 42, and one end of the installation module 4 forms a slot 31 and the first contact pin 32. No matter which way of implementation, it is applicable as long as they can achieve the plug-and-play conductive function and are convenient to replace the installation module. At the same time, in order to ensure good contact, the one end of the connection mechanism 3 is in electrical contact with the PCB board 11 through the elastic sheet 33.

Embodiment 1 shows a strip lighting with a vertical installation structure, as shown in FIG. 1 and FIG. 4 to 5. Correspondingly, the installation module 4 comprises a DC plug which is an "L" structure formed by a female plug 43 and a male plug 44, a DC end cap 45 sleeved on the outer periphery of the female plug 43 and fixed with the female plug 43, and a vertical bracket 46 connected to the male plug 44 to support the entire strip lighting, the insertion barrel 41 is formed on the female plug 43. The female plug 43, which is socket with DC end cap 45, extends into the lighting end cover 2 and is electrically connected with the connection mechanism 3.

That is, the female plug 43 is fixedly sleeved in the DC end cap 45 and then inserts into the lighting end cover 2. The insertion barrel 41 on the female socket 43 and the second contact pin 42 formed in the insertion barrel 41 are correspondingly connected respectively with the slot 31 on the connection mechanism 3 and the first contact pin 32 located in the slot 31 to realize the electrical connection between the DC plug and the connection mechanism 3. In order to achieve a fixed connection between the female plug 43 and the DC end cap 45, both the DC end cap 45 and the female plug 43 are provided with mounting holes (not shown in figures), and the DC end cap 45 and the female plug 43 are fixedly connected by screws 48.

The diameter of the DC end cap 45 protruding into the lighting end cover 2 is slightly larger than the diameter of the other end of the connection mechanism 3, so that the DC end cap 45 is just fitted on the other end surface of the connection mechanism 3. In order to prevent the DC plug from rotating arbitrarily in the lighting end cover 2, the surface of the portion of the DC end cap 45 extending into the lighting end cover 2 is provided with an annular groove 451 in which an O-ring 5 is provided. The inner wall of the lighting end cover 2 is provided with an annular groove 21 for embedding the O-ring 5. Due to its elasticity, O-ring 5 can be deformed during installation without obstructing the installation. Moreover, its material nature enables it to produce greater friction relative to each contact wall, so as to prevent arbitrary rotation of the parts.

Similarly, the male plug 44 is inserted into the vertical bracket 46 and an O-ring 5 is provided between the male plug 44 and the vertical bracket 46 to prevent the male plug 44 from rotating randomly in the vertical bracket 46.

Embodiment 2 shows a strip lighting with a surface-mount installation structure. FIGS. 2 and 6 only show a schematic structural view of one end of the strip lighting, and the other end has the same structure, so it is omitted. The installation module 4 is a plug-in Wiring, one end of which forms the insertion barrel 41 and the second contact pin 42 and the other end is connected to the wire 6, and most of such lightings are directly fixedly mounted on a mounting surface such as a wall.

Figure 8:
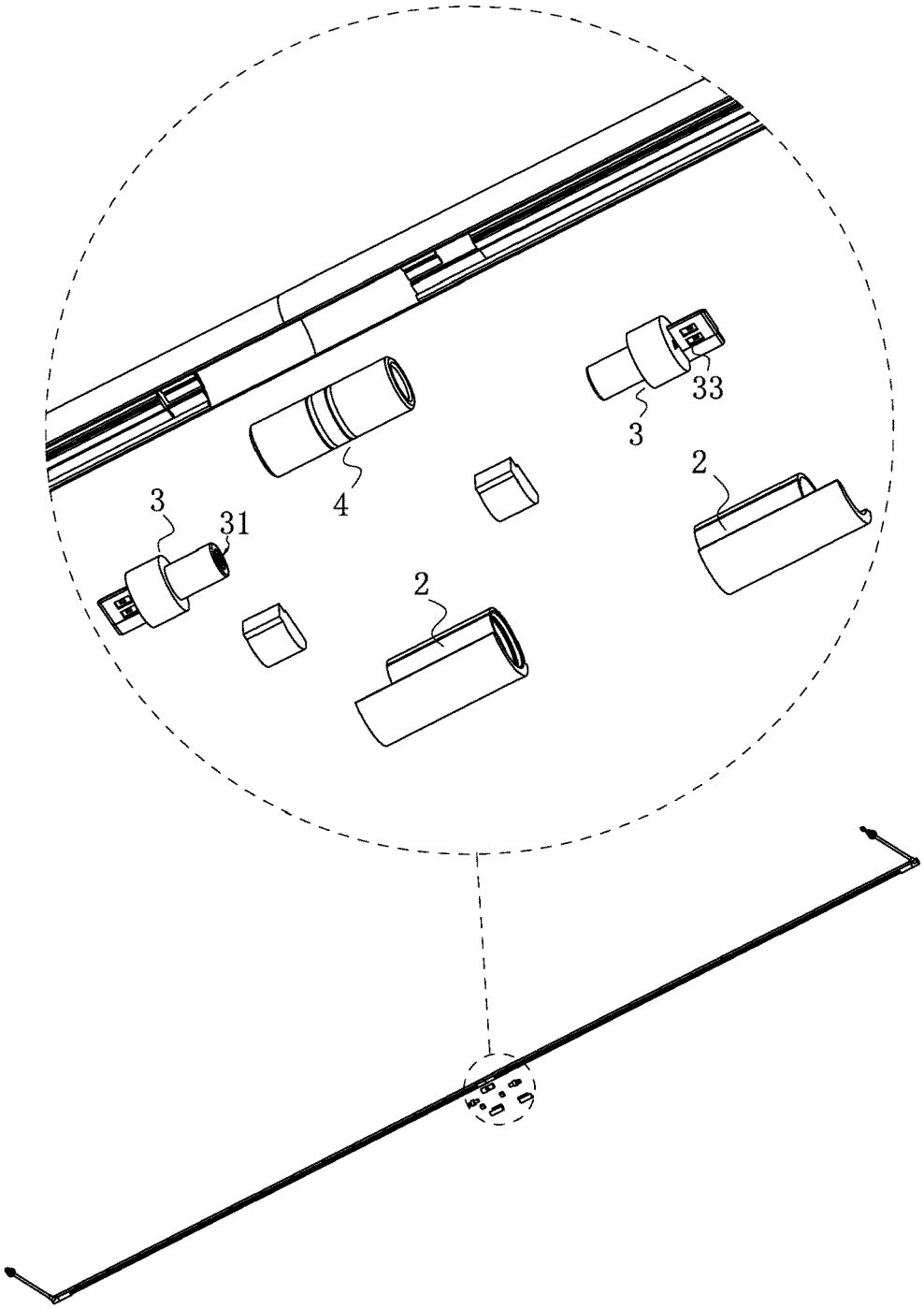
FIG. 8 is a schematic diagram of the series structure of the strip lighting corresponding to FIG. 3 after serial installation.

Embodiment 3 shows a strip lighting with a series installation function, as shown in FIG. 3 and FIGS. 8 to 9, the installation module 4 includes a cylindrical connecting piece with openings at both ends to connect the strip lighting and the strip lighting in series. The cylindrical connecting piece is provided with the insertion barrel 41 and the second contact pin 42 formed and connected along the respective opening directions, and the ends of the cylindrical connecting piece can respectively extend into the lighting end cover 2 of the corresponding strip lighting so that the insertion barrel 41 and the slot 31 are connected, and the second contact pin 42 and the insertion barrel 41 are correspondingly connected. In order to prevent the cylindrical connecting piece from rotating arbitrarily in the lighting end cover 2, an O-ring is provided on the surface of the cylindrical connecting piece. Obviously, in order to ensure that the lighting can conduct electricity, the ends of the strip lights at the two ends of the series are either constituted by a vertical structure installation module or a surface-mounted installation module. The installation module of vertical structure is assembled in this application, as shown in FIG. 3.

Regardless of whether it is a vertical installation method, a surface-mount installation method, or a series connection method, once the lighting requirements change, the lighting angle of the lighting needs to be adjusted accordingly to achieve the lighting purpose, but the existing lightings cannot complete this function. In order to overcome this problem, as an improvement, the insertion barrel 41 of the present application can be rotated in the slot 31. Since the insertion barrel 41 is formed on the installation module 4, the slot 31 is formed on the connection mechanism 3, and the connection mechanism 3 and the strip lighting body 1 is fixedly connected, so that the insertion barrel 41 can rotate in the slot 31, which actually means that the installation module 4 can rotate relative to the strip lighting body 1. The change of the angle of the installation module 4 relative to the strip lighting body 1 is actually corresponding to the change of the angle of the strip lighting body 1 relative to the installation surface. Therefore, the irradiation angle can be changed in this way.

Specifically, the insertion barrel 41 and the slot 31 are designed with a columnar structure. Similarly, in order to better achieve this purpose, the lighting end cover 2 also adopts a cylindrical structure design with openings at both ends and a hollow columnar structure inside. The cylindrical structure corresponds to a smooth curved surface, and the smooth performance of the smooth curved surface ensures that the lighting can achieve the adjustment of 360° irradiation angle. Meanwhile, it cooperates with the O-ring to prevent the installation module from rotating arbitrarily in the lighting end cover, which well realizes the maintenance of the adjustment angle.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. A strip lighting, comprising a strip lighting body (1) and a lighting end cover (2) fixedly arranged at both ends of the strip lighting body (1), characterized by:

the strip lighting further comprises a connection mechanism (3) fixedly disposed in the lighting end cover (2) and one end of which electrically connected to a PCB board (11) in the strip lighting body (1), and an installation module (4) that is electrically connected to the other end of the connection mechanism (3) by a pluggable method and detachably connected to the lighting end cover (2) for easy replacement, the installation module (4) comprises a DC plug which is an "L" structure formed by a female plug (43) and a male plug (44), a DC end cap (45) sleeved on the outer periphery of the female plug (43) and fixed with the female plug (43), and a vertical bracket (46) connected to the male plug (44) to support the entire strip lighting;

wherein a slot (31) formed along the lengthwise direction of the strip lighting body (1) is provided on the other end of the connection mechanism (3), and a first contact pin (32) is disposed in the slot (31) along the length direction of the strip lighting body (1), correspondingly, an insertion barrel (41) is provided at one end of the installation module (4), and a second contact pin (42) formed along the lengthwise direction of the insertion barrel (41) is provided in the insertion barrel (41), the first contact pin (32) is adapted to be inserted into the insertion barrel (41) and to make electrical contact with the second contact pin (42), and the insertion barrel (41) can rotate in the slot (31) to rotate the strip lighting body (1) relative to the installation module (4) is formed on the female plug (43), and the female plug (43) sleeved with the DC end cap (45) extends into the lighting end cover (2) and is electrically connected to the connection mechanism (3).

2. The strip lighting as claimed in claim 1, wherein the diameter of the DC end cap (45) extending into the lighting end cover (2) is adapted to the other end of the connection mechanism (3), so that the DC end cap (45) is fitted on the other end surface of the connection mechanism (3).

3. The strip lighting as claimed in claim 1, wherein an annular groove (451) is provided on the surface of the portion of the DC end cap (45) extending into the lighting end cover (2), and an O-ring (5) is provided in the annular groove (451), and an annular groove (21) for embedding the O-ring (5) is provided at a corresponding position on the inner wall of the lighting end cover (2) to prevent the DC end cap (45) from rotating arbitrarily.

4. The strip lighting as claimed in claim 1, wherein the male plug (44) is inserted into the vertical bracket (46) and an O-ring (5) is provided between the male plug (44) and the vertical bracket (46) to prevent the male plug (44) from rotating randomly.

5. The strip lighting as claimed in claim 1, wherein the DC end cap (45) and the female plug (43) are provided with mounting holes, and the DC end cap (45) and the female plug (43) are fixed by screws (48).

6. The strip lighting as claimed in claim 1, wherein the installation module (4) comprises a cylindrical connecting piece that is open at both ends and connects the strip lighting and the strip lighting in series;

the cylindrical connecting piece is provided with the insertion barrel (41) and the second contact pin (42) formed and connected along the respective opening directions, and the ends of the cylindrical connecting piece can respectively extend into the lighting end cover (2) of the corresponding strip lighting, so that the insertion barrel (41) and the slot (31), the second pin (42) and the first pin (32) are connected correspondingly.

7. The strip lighting as claimed in claim 2, wherein the surface of the cylindrical connecting piece is provided with an O-ring (5) which can prevent the cylindrical connecting piece from rotating randomly within the lighting end cover (2).

8. The strip lighting as claimed in claim 1, wherein the installation module (4) is a plug-in wiring, one end of which forms the insert barrel (41) and the second contact pin (42) and other end is connected to a wire (6) to realize the overall surface mounting of the strip lighting installation.

9. The strip lighting as claimed in claim 1, wherein an elastic sheet (33) electrically contacts contacted with the PCB board (11) is provided on one end of the connection mechanism (3).

10. The strip lighting as claimed in claim 1, wherein the insertion barrel (41) can rotate in the slot (31) to rotate the strip lighting body (1) relative to the installation module (4).

11. The strip lighting as claimed in claim 10, wherein the lighting end cover (2) is a cylindrical body with openings at both ends and a hollow columnar structure inside.

* * * * *